US011253075B2

(12) United States Patent
Lah

(10) Patent No.: US 11,253,075 B2
(45) Date of Patent: Feb. 22, 2022

(54) PORTABLE CHAIR

(71) Applicant: DONGAH ALUMINUM CORPORATION, Incheon (KR)

(72) Inventor: Jeh Kun Lah, Seoul (KR)

(73) Assignee: DONGAH ALUMINUM CORPORATION, Incheon (KR)

( * ) Notice: Subject to any disclaimer, the term of this patent is extended or adjusted under 35 U.S.C. 154(b) by 0 days.

(21) Appl. No.: 16/912,745

(22) Filed: Jun. 26, 2020

(65) Prior Publication Data

US 2021/0015263 A1 Jan. 21, 2021

(30) Foreign Application Priority Data

Jul. 19, 2019 (KR) ..... 10-2019-0087606

(51) Int. Cl.

| | |
|---|---|
| ***A47C 4/02*** | (2006.01) |
| ***A47C 4/30*** | (2006.01) |
| ***A47C 5/10*** | (2006.01) |
| ***A47C 9/10*** | (2006.01) |

(52) U.S. Cl.

CPC ..... *A47C 4/30* (2013.01); *A47C 4/022* (2013.01); *A47C 4/028* (2013.01); *A47C 5/10* (2013.01)

(58) Field of Classification Search

CPC .. A47C 4/30; A47C 5/10; A47C 4/022; A47C 4/028; A47C 4/42; A47C 4/02; A47C 4/283; A47C 4/28; A47C 4/00; A47C 4/045; A47C 4/024

USPC ..... 297/16.2, 42, 45, 452.55–452.57

See application file for complete search history.

(56) References Cited

U.S. PATENT DOCUMENTS

| | | | | | |
|---|---|---|---|---|---|
| 2,001,252 | A * | 5/1935 | Johnson | A47C 7/024 | 297/350 |
| 2,090,562 | A * | 8/1937 | Walter | A47C 4/30 | 297/219.1 |
| 2,292,586 | A * | 8/1942 | Thompson | A47C 4/02 | 297/44 |
| 2,785,734 | A * | 3/1957 | Yngve | A47C 5/06 | 297/440.11 |
| 3,902,753 | A * | 9/1975 | Wilson | A47C 1/143 | 297/185 |
| 4,547,015 | A * | 10/1985 | Wakimoto | A47C 4/286 | 297/16.2 |

(Continued)

FOREIGN PATENT DOCUMENTS

| | | | | |
|---|---|---|---|---|
| DE | 10219539 A1 * | 11/2003 | ..... | A47C 4/045 |
| EP | 0 677 262 A1 | 10/1995 | | |

(Continued)

OTHER PUBLICATIONS 11 page PDF of machine translation of KR 200483430/2020160003567. (Year: 2017).*

(Continued)

*Primary Examiner* — Robert Canfield

(74) *Attorney, Agent, or Firm* — Nixon Peabody LLP; Jeffrey L. Costellia

(57) ABSTRACT

A portable chair according to the present disclosure includes a chair frame formed by detachably coupling a plurality of poles, a chair cover detachably coupled to the chair frame and made of a flexible material supporting the body of a user, and a seat member installed at a portion of the chair cover, which supports a hip portion of the user, and made of a hard material.

7 Claims, 12 Drawing Sheets

(56) References Cited

U.S. PATENT DOCUMENTS

| | | | | | |
|---|---|---|---|---|---|
| 4,824,171 | A * | 4/1989 | Hollingsworth | A47C 1/146 | 297/351 |
| 5,676,419 | A * | 10/1997 | Kassai | B62B 7/08 | 297/44 |
| 6,058,535 | A * | 5/2000 | Firkins, Jr | A47C 7/021 | 5/653 |
| 9,066,593 | B2 * | 6/2015 | Homans | A47C 4/03 | |
| D815,448 | S * | 4/2018 | Jin | D6/368 | |
| D833,768 | S * | 11/2018 | Jin | D6/368 | |
| 10,653,244 | B2 * | 5/2020 | Yang | A47C 3/025 | |
| 10,881,211 | B1 * | 1/2021 | Al-Salloom | A47C 4/04 | |
| 2002/0117878 | A1 * | 8/2002 | Fox | A47C 9/105 | 297/16.2 |
| 2012/0104805 | A1 * | 5/2012 | Lah | A47C 4/286 | 297/16.1 |
| 2015/0137566 | A1 * | 5/2015 | Wagner | A47B 83/0213 | 297/135 |
| 2015/0335136 | A1 * | 11/2015 | Wehner | A47C 4/18 | 297/273 |
| 2016/0113402 | A1 * | 4/2016 | Lee | A47C 4/42 | 297/16.2 |
| 2017/0311723 | A1 * | 11/2017 | Lenhart | A47C 4/28 | |
| 2018/0235368 | A1 * | 8/2018 | Graybill | A47C 4/286 | |

FOREIGN PATENT DOCUMENTS

| | | | | |
|---|---|---|---|---|
| EP | 1042976 | A1 * | 10/2000 | A47C 3/00 |
| EP | 3340837 | | 7/2018 | |
| FR | 2700743 | A1 * | 7/1994 | |
| JP | 6-197821 | A | 7/1994 | |
| JP | 1995-329789 | A | 12/1995 | |
| JP | 2004-041400 | A | 2/2004 | |
| JP | 2017-536148 | A | 12/2017 | |
| KR | 20-2009-0011740 | A | 11/2009 | |
| KR | 10-2015-0133537 | A | 11/2015 | |
| KR | 20-0480869 | | 7/2016 | |
| KR | 10-2017-0003840 | A | 1/2017 | |
| KR | 10-1703987 | | 2/2017 | |
| KR | 10-1727880 | * | 4/2017 | A47C 4/022 |
| KR | 20-0483430 | * | 5/2017 | A47C 4/022 |
| TW | 546755 | | 8/2017 | |
| WO | WO-2017-032913 | | 3/2017 | |

OTHER PUBLICATIONS 12 page PDF of machine translation of KR 101727880. (Year: 2017).*

Korean Office Action for Application No. 10-2019-0087606, dated Dec. 16, 2020.

European Search Report for Application No. 19207755.0, dated Nov. 25, 2019.

Japanese Office Action for Application No. 2019-206231, dated Sep. 1, 2020.

Japanese Office Action for Application No. 2019-206231, dated May 11, 2021.

* cited by examiner

PORTABLE CHAIR

TECHNICAL FIELD

The present disclosure relates to a portable chair.

BACKGROUND ART

Recently, due to the increase in outdoor activities such as camping and fishing, various types of portable chairs are provided. The portable chair should be easy to carry, simple to install, and able to give stability to the user when being used. Various attempts have been made to provide a portable chair that can meet these conditions.

Patent Literature 1 discloses a portable chair in which a main frame and a seat member of a chair are coupled to each other. In Patent Literature 1, the seat member is made of a flexible material as a whole, so that when the user sits on the chair, the seat member sags downward by the weight of the user. Accordingly, the seat member surrounds the user on both the left and right sides to restrains the movement of the user sitting on the chair, thereby failing to provide stable seating feeling.

RELATED LITERATURE

Patent Literature

Patent Literature 1: Korean Utility Model Registration No. 20-0480869

DISCLOSURE

Technical Problem

The present disclosure is directed to providing a portable chair, which may give comfortable seating feeling while supporting a user stably.

Technical Solution

In an example, there is provided a portable chair, comprising: a chair frame formed by detachably coupling a plurality of poles; a chair cover detachably coupled to the chair frame and made of a flexible material supporting the body of a user; and a seat member installed at a portion of the chair cover, which supports a hip portion of the user, and made of a hard material.

In another example, the seat member may be made of two or more boards, which are coupled to be folded with each other.

In still another example, the chair frame may include: a central support pole disposed in parallel to the ground; a plurality of front support poles respectively having base ends detachably connected to both ends of the central support pole and respectively having free ends extending in a front upper direction at a predetermined angle with the ground; a plurality of rear support poles respectively having base ends detachably connected to both ends of the central support pole and respectively having free ends extending in a rear upper direction at a predetermined angle with the ground; and a plurality of leg poles respectively having base ends detachably connected to both ends of the central support pole and respectively having free ends extending in a lower direction to contact the ground.

In still another example, the seat member may have a bottom surface located to be spaced apart from the central support pole in an upper direction.

In still another example, the seat member may have a bottom surface supported in contact with the central support pole.

In still another example, the chair cover may have an elastic clip protruding on the bottom surface of the seat member and be fixed to the central support pole as the central support pole is inserted into the elastic clip.

In still another example, the chair cover may include a Velcro tape coupled to the bottom surface of the seat member to fix the central support pole.

In still another example, the portable chair may further comprise a rear support member installed at a portion of the chair cover, which supports the occipital region or the back region of the user, and made of a hard material.

In still another example, the chair frame may include: a central support pole disposed in parallel to the ground; a plurality of front support poles respectively having base ends detachably connected to both ends of the central support pole and respectively having free ends extending in a front upper direction at a predetermined angle with the ground; a plurality of rear support poles respectively having base ends detachably connected to both ends of the central support pole and respectively having free ends extending in a rear upper direction at a predetermined angle with the ground; and a plurality of leg poles respectively having base ends detachably connected to both ends of the central support pole and respectively having free ends extending in a lower direction to contact the ground, wherein the rear support member may be formed across the free ends of the plurality of rear support poles.

In still another example, the plurality of rear support poles may include first extensions respectively having base ends connected to both ends of the central support pole and the other ends extending in a rear upper direction at a first angle with the ground, and second extensions respectively having base ends connected to the other ends of the first extensions and free ends extending in a rear upper direction at a second angle with the ground, and the first angle may be smaller than the second angle so that the rear support pole has a bent shape.

In still another example, the chair cover may have pockets provided at locations corresponding to the free ends of the front support poles and the rear support poles to be coupled with the free ends, respectively.

In still another example, the free ends of the front support poles and the pockets corresponding thereto may be coupled with each other in a snap-fitting fashion.

In still another example, a front end of the seat member may protrude forward further to the free ends of the front support poles in a horizontal direction, and the free ends of the rear support poles may protrude rearward further to a rear end of the seat member in a horizontal direction.

In still another example, the portable chair may further comprise a cushion member coupled to an upper surface of the seat member.

BEST MODE

Figure 1:
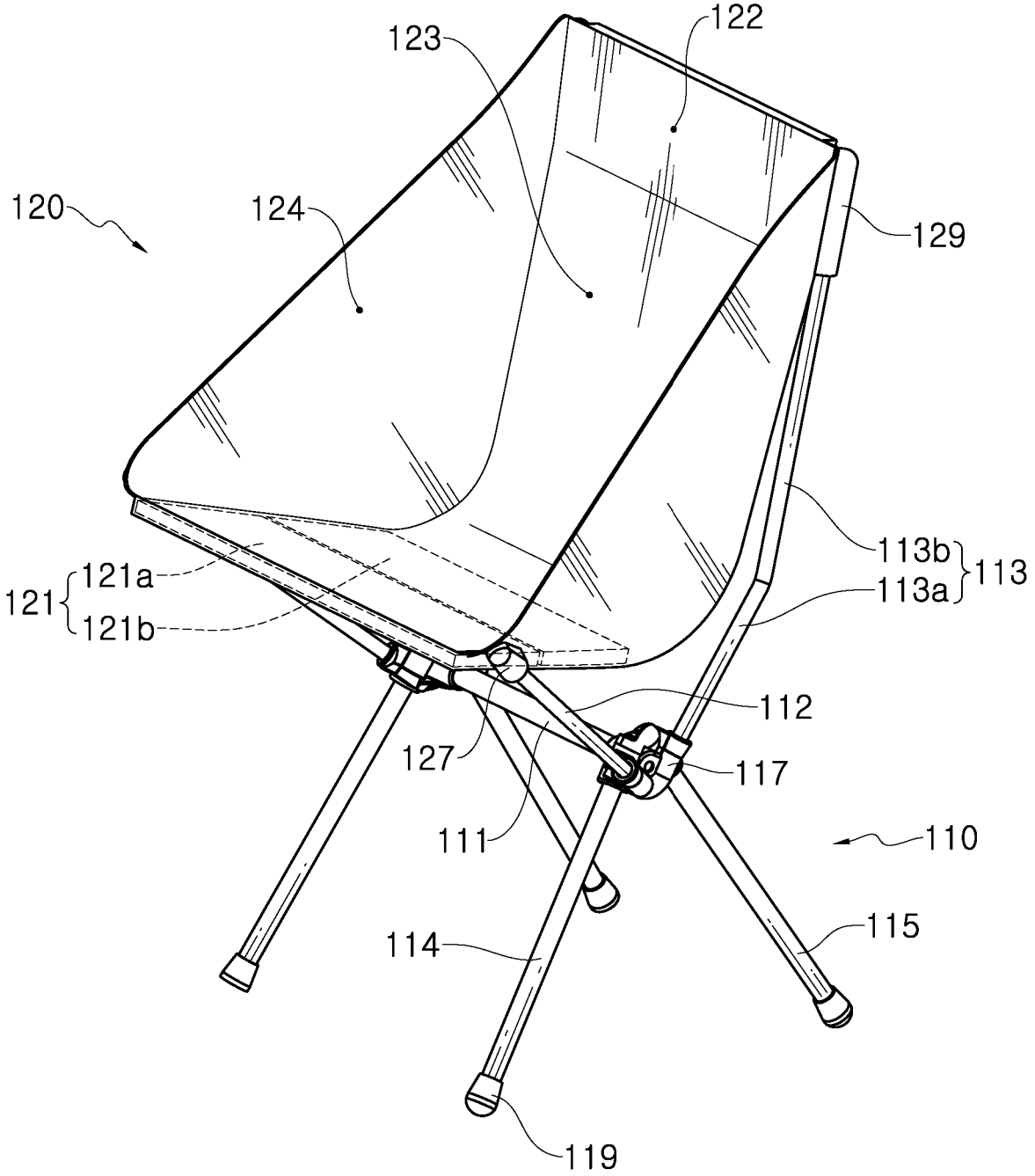
FIG. 1 is a perspective view showing a portable chair according to the first embodiment of the present disclosure.

Hereinafter, embodiments of the present disclosure will be described in detail with reference to the accompanying drawings. It should be noted that, in adding reference numerals to the components of the drawings, the same components are denoted by the same reference symbols as possible even if they are shown in different figures. Further, in the description of the embodiments of the present disclosure, the detailed description of the known structure or function will be omitted if it is judged that it interferes with the understanding of the embodiments of the present disclosure.

First Embodiment

Figure 2:
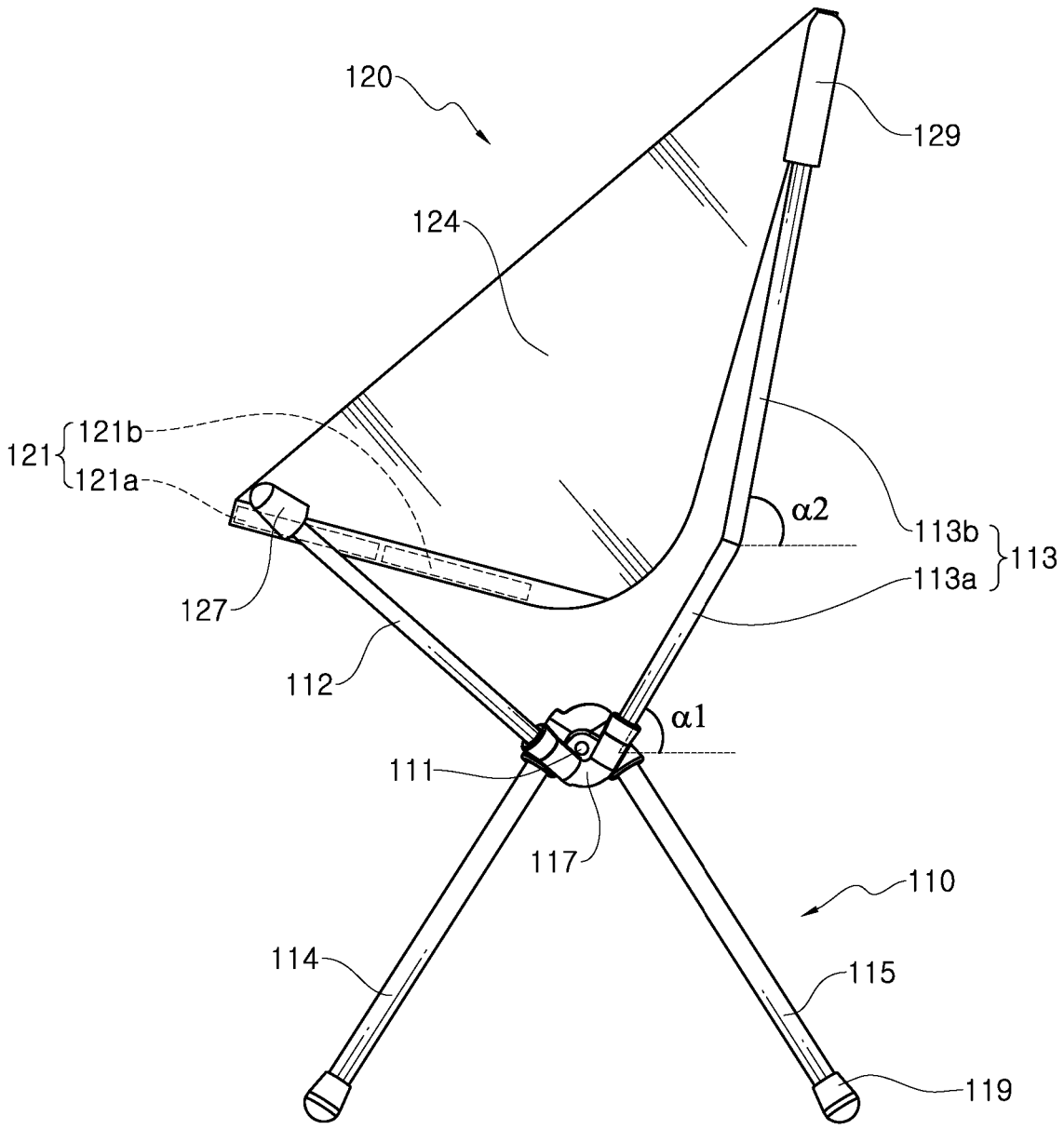
FIG. 2 is a side view showing the portable chair according to the first embodiment of the present disclosure.
Figure 3:
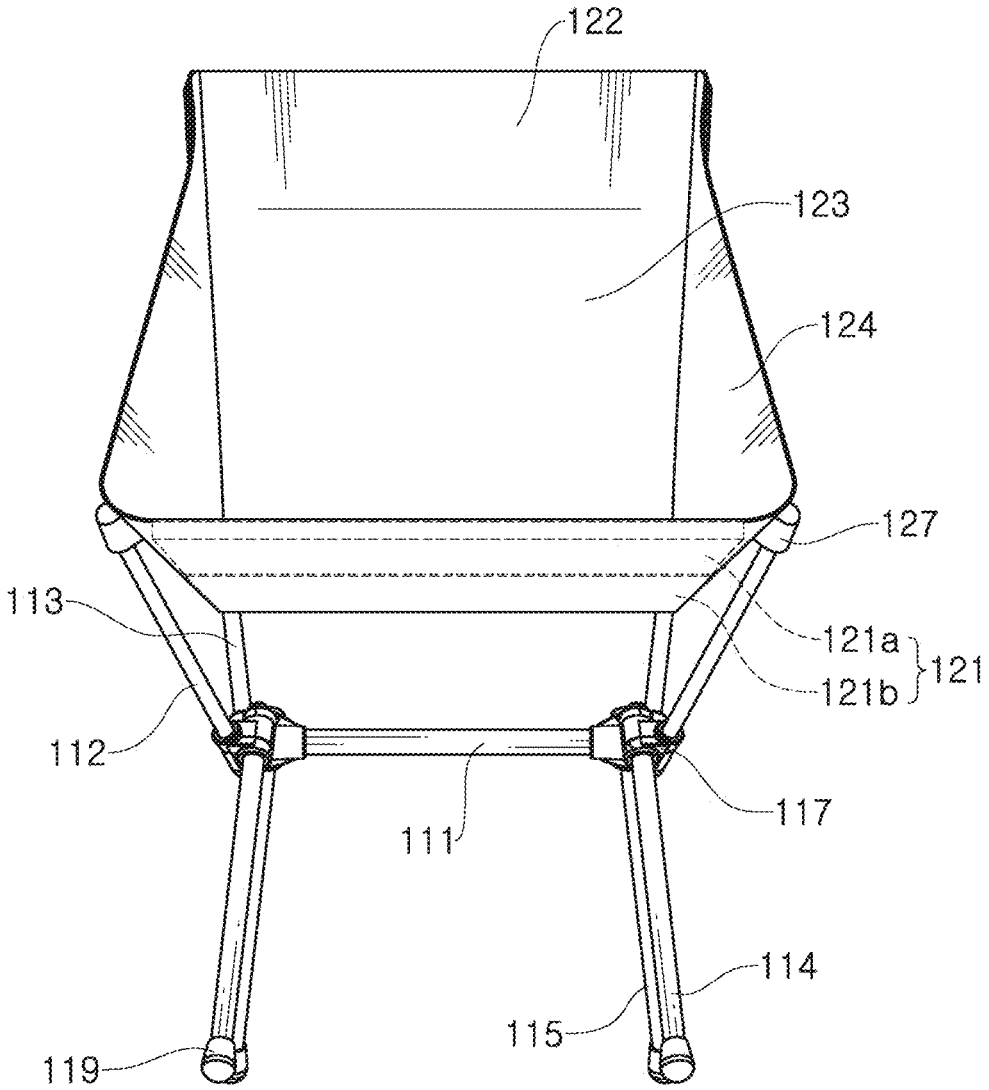
FIG. 3 is a front view showing the portable chair according to the first embodiment of the present disclosure.
Figure 4:
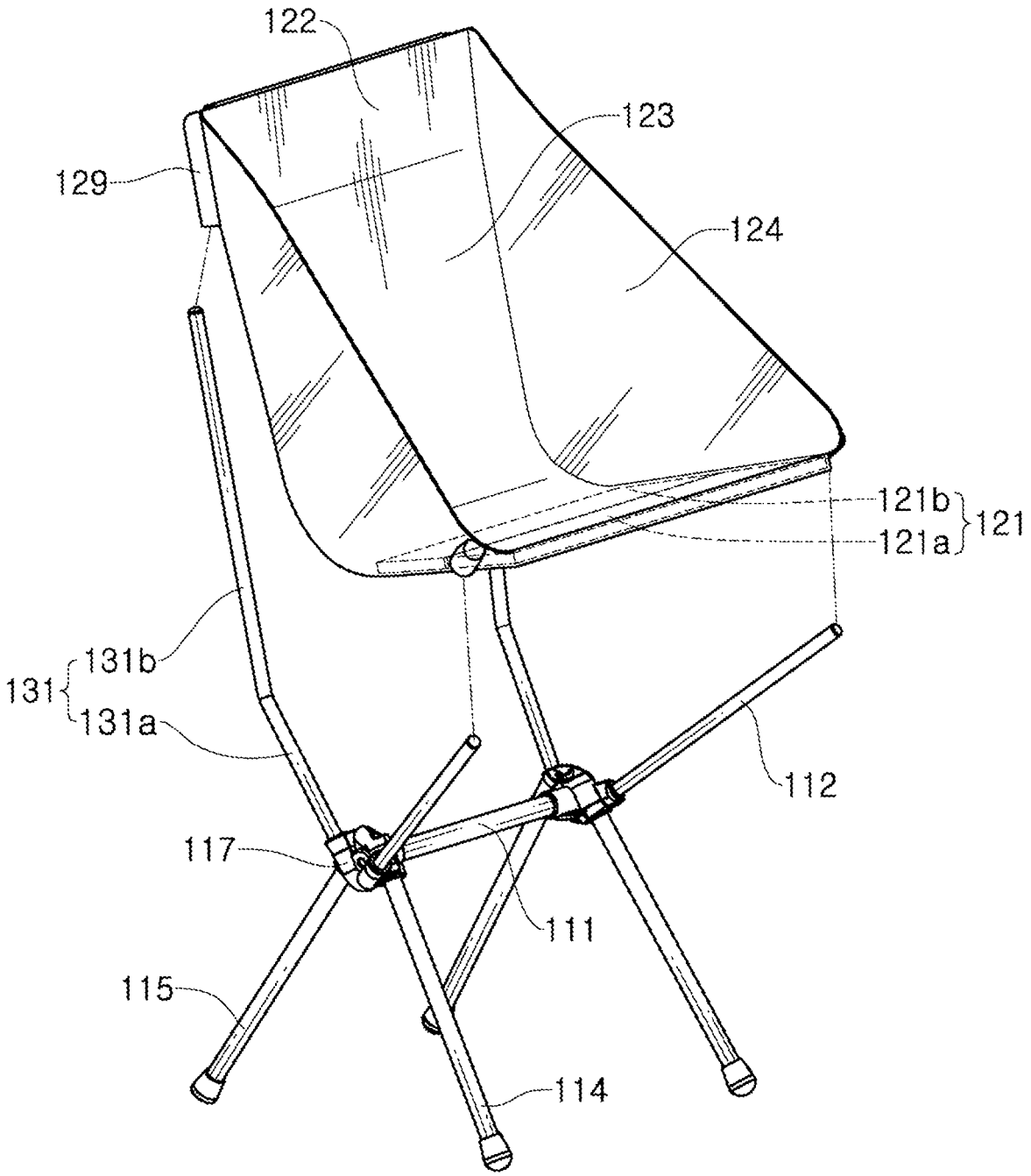
FIG. 4 is an exploded perspective view showing the portable chair according to the first embodiment of the present disclosure.

FIG. 1 is a perspective view showing a portable chair according to the first embodiment of the present disclosure. FIG. 2 is a side view showing the portable chair according to the first embodiment of the present disclosure. FIG. 3 is a front view showing the portable chair according to the first embodiment of the present disclosure. FIG. 4 is an exploded perspective view showing the portable chair according to the first embodiment of the present disclosure. Hereinafter, the portable chair according to the first embodiment of the present disclosure will be described with reference to FIGS. 1 to 4.

In the following description, the "front" means a direction (a left direction in FIG. 2) toward the front of the chair in which a user sits on the portable chair, and the "rear" means a direction (a right direction in FIG. 2) toward the back of the chair, which is opposite to the "front".

Referring to FIGS. 1 to 4, the portable chair according to the first embodiment of the present disclosure includes a chair frame 110, a chair cover 120, a seat member 121, and a rear support member 122. The chair cover 120 is detachably coupled to the chair frame 110, and the chair frame 110 is formed by detachably coupling a plurality of poles to each other. The seat member 121 and the rear support member 122 will be described later.

First, the chair frame 110 includes a central support pole 111, a plurality of front support poles 112, a plurality of rear support poles 113 and a plurality of leg poles 114, 115. The central support poles 111, the front and rear support poles 112, 113 and the plurality of leg poles 114, 115 are detachably coupled to each other.

The central support pole 111 is disposed in parallel to the ground. A pair of hubs 117 are coupled to both ends of the central support pole 111, respectively, and are coupled to the central support pole 111 as the plurality of front support poles 112, the plurality of rear support poles 113 and the plurality of leg poles 114, 115 are detachably coupled to the pair of hubs 117.

The plurality of front support poles 112 respectively have base ends detachably connected to both ends of the central support pole 111 through the hub 117 and respectively have free ends extending in a front upper direction at a predetermined angle with the ground. The plurality of rear support poles 113 respectively have base ends detachably connected to both ends of the central support pole 111 through the hub 117 and respectively have free ends extending in a rear upper direction at a predetermined angle with the ground.

At this time, the plurality of rear support poles 113 include first extensions 113*a* and second extensions 113*b* to have a bent shape as a whole (see FIG. 2). More specifically, the plurality of first extension 113*a* respectively have base ends connected to both ends of the central support pole 111 and respectively have the other ends extending in a rear upper direction at a first angle $\alpha 1$ with the ground. In addition, the plurality of second extension 113*b* respectively have base ends connected to the other ends of the first extensions 113*a* and respectively have free ends extending in a rear upper direction at a second angle $\alpha 2$ with the ground. The first angle $\alpha 1$ is smaller than the second angle $\alpha 2$, so that the rear support pole 113 has a bent shape.

Meanwhile, though the angles from the front support poles 112 and the first extensions 113*a* to the ground are not particularly limited, the angle between the front support poles 112 and the ground may be smaller than the angle between the first extensions 113*a* and the ground in order to stably support the weight of the user.

The plurality of leg poles 114, 115 respectively have base ends detachably connected to both ends of the central support pole 111 through the hub 117 and respectively have free ends extending in a lower direction to contact the ground. The plurality of leg poles 114, 115 include a plurality of front leg poles 114 extending in a front lower direction at a predetermined angle with the ground and a plurality of rear leg poles 115 extending in a rear lower direction at a predetermined angle with the ground. Protection caps 119 are respectively coupled to the free ends of the plurality of leg poles 114, 115 so that the leg poles 114, 115 can be stably landed on the ground and the free ends of the leg poles 114, 115 are prevented from being deformed or damaged.

The chair cover 120 is detachably coupled to the chair frame 110 configured as above. The chair cover 120 is made of a flexible material and has a rear surface 123 and a pair of side surfaces 124.

At this time, the seat member 121 is installed to a portion of the chair cover 120, which supports the hip portion of the user. In addition, the seat member 121 is made of a hard material (for example, a plastic board). Thus, when the user sits on the chair, the chair cover 120 may stably support the user to give comfort seating feeling without sagging downward. As shown in FIGS. 1 to 4, the seat member 121 is inserted into the chair cover 120. However, without being limited thereto, the seat member 121 may also be coupled to an outer side of the chair cover 120.

In addition, the seat member 121 is configured to be folded. More specifically, the seat member 121 is made of two boards 121*a*, 121*b*, which are coupled in a direction parallel to the longitudinal direction of the central support pole 111. The two boards 121*a*, 121*b* may be hinged to be folded inwardly so that their upper surfaces face each other when being folded. Thus, when the chair frame 110 and the chair cover 120 are separately stored, the volume occupied by the chair cover 120 may be reduced by folding the seat member 121. In addition, in use, the user sits on the seat member 121 to apply a force so that the two boards 121*a*, 121*b* are unfolded, thereby preventing the seat member 121 from being folded during use.

Meanwhile, even though the embodiment depicted in the figures illustrate that the seat member 121 is made of two boards, the seat member 121 may also be configured to have three or more boards coupled to each other.

In addition, the rear support member 122 is installed to a portion of the chair cover 120, which supports the occipital region or the back region of the user. More specifically, the rear support member 122 is installed across the free ends of the plurality of rear support poles 113. In addition, the rear support member 122 is also made of a hard material (for example, a plastic board). Accordingly, the rear support member 122 supports the user together with the seat member 121 when the user sits, thereby preventing the chair cover 120 from sagging downward and rearward and giving the user with stable seating feeling. Though the rear support member 122 is inserted into the inside of the chair cover 120, it is also possible that the rear support member 122 is coupled to the outer side of the chair cover 120.

Meanwhile, the rear surface 123 refers to a portion of the chair cover 120, which extends upward at a rear edge of the seat member 121. In addition, the pair of side surfaces 124 refer to portions of the chair cover 120, which extend at both side edges of the seat member 121 toward both side edges of the rear surface 123, and the pair of side surfaces 124 and the rear surface 123 form a space where the user sits.

At this time, the chair cover 120 including the rear surface 123 and the side surfaces 124 is made of a flexible material (for example, a cloth material). In other words, the seat member 121 and the rear support member 122 are made of a harder material than the chair cover 120. Thus, the seat member 121 and the rear support member 122 give stable seating feeling to the user, while the rear surface 123 and the side surfaces 124 do not restrain the movement of the user to give comfort to the user.

Meanwhile, the chair cover 120 includes pockets 127, 129 for coupling with the chair frame 110. The pockets 127, 129 are formed at locations corresponding to the free ends of the front cover poles 112 and the rear support poles 113 of the chair cover 120. As the free ends of the front support poles 112 and the free ends of the rear support poles 113 are coupled to the pockets 127, 129, the chair cover 120 is coupled to the chair frame 110.

More specifically, the pockets 127, 129 include a front pocket 127 formed at a location corresponding to the free end of the front support pole 112 and a rear pocket 129 formed at a location corresponding to the free end of the rear support pole 113.

The front pocket 127 has a groove (not shown) into which the free end of the front support pole 112 is inserted. In addition, the rear pocket 129 is formed to extend along the longitudinal direction of the rear support pole 113, so that the free end of the rear support pole 113 is inserted deeply along the longitudinal direction of the rear pocket 129. After the rear pocket 129 is inserted into the rear support pole 113 first, the front pocket 127 is inserted into the front support pole 112 while elastically deforming the chair frame 110, thereby easily coupling the chair cover 120 to the chair frame 110.

Further, since the rear support pole 113 has a bent shape as described above, it is possible to prevent the user from sagging rearward and also couple the chair cover 120 and the chair frame 110 more easily.

In addition, since the pockets 127, 129 of the chair cover 120 are coupled to the free ends of the front support pole 112 and the rear support pole 113, the seat member 121 is positioned to be spaced apart from the central support pole 111 in an upper direction. Thus, in use, the user only comes into contact with the seat member 121 and may have stable seating feeling without foreign body feeling.

Moreover, the portable chair according to the first embodiment of the present disclosure includes a cushion member (not shown) coupled to a top surface of the seat member 121. The cushion member may give the user with more comfortable seating feeling. The cushion member may be formed at an upper side of the seat member 121 within the chair cover 120 or may be formed at the outer side of the chair cover 120.

Second Embodiment

Figure 5:
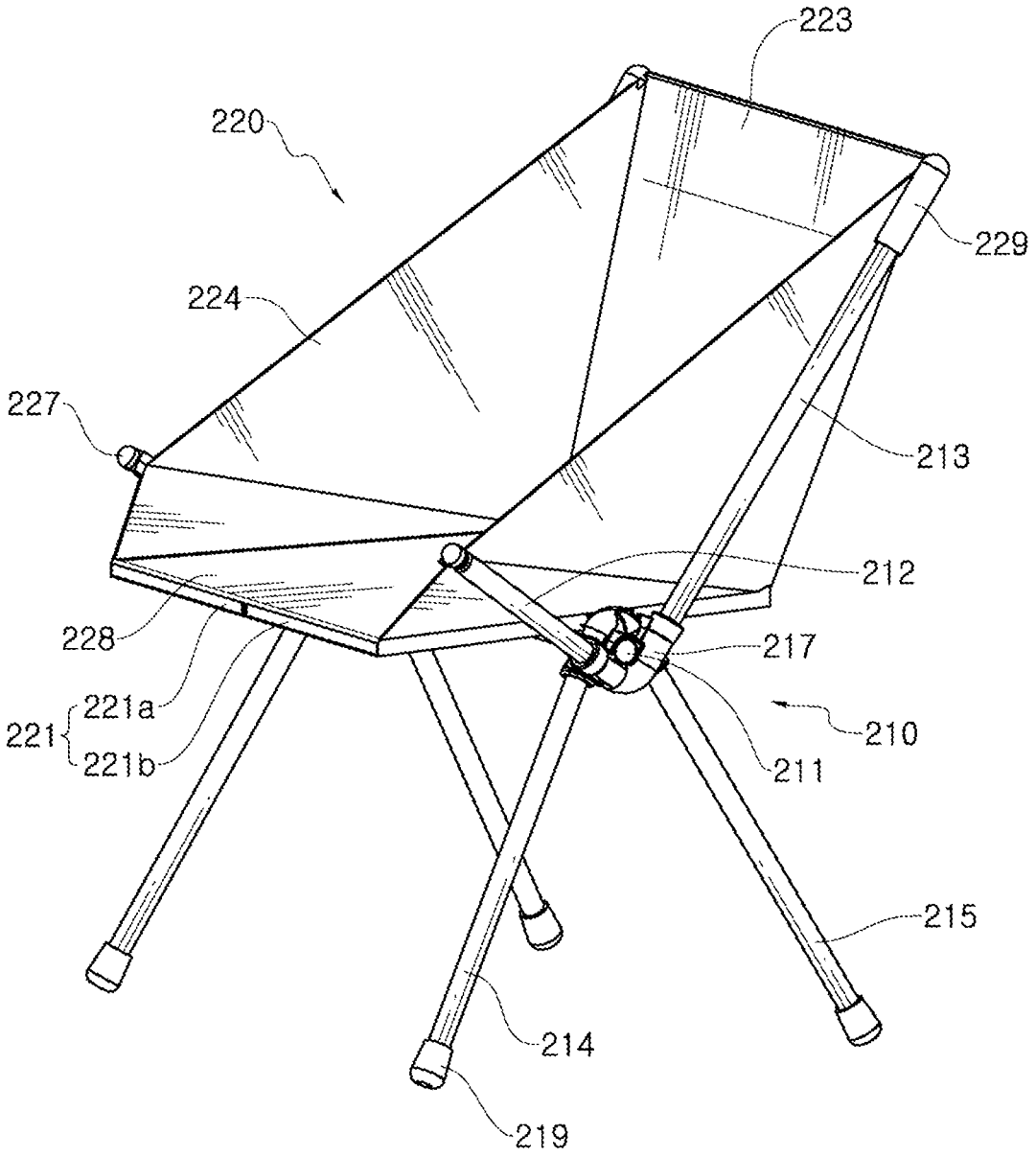
FIG. 5 is a perspective view showing a portable chair according to the second embodiment of the present disclosure.
Figure 6:
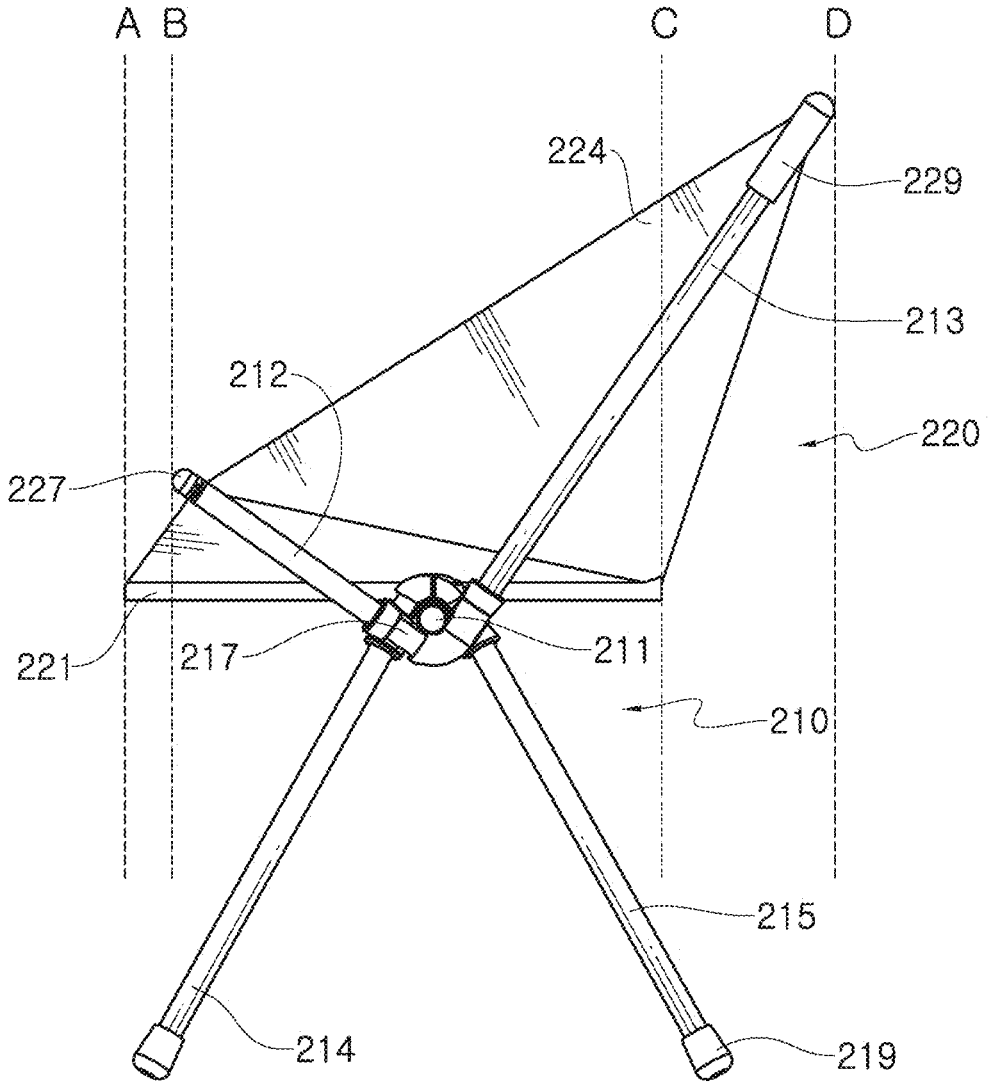
FIG. 6 is a side view showing the portable chair according to the second embodiment of the present disclosure.
Figure 7:
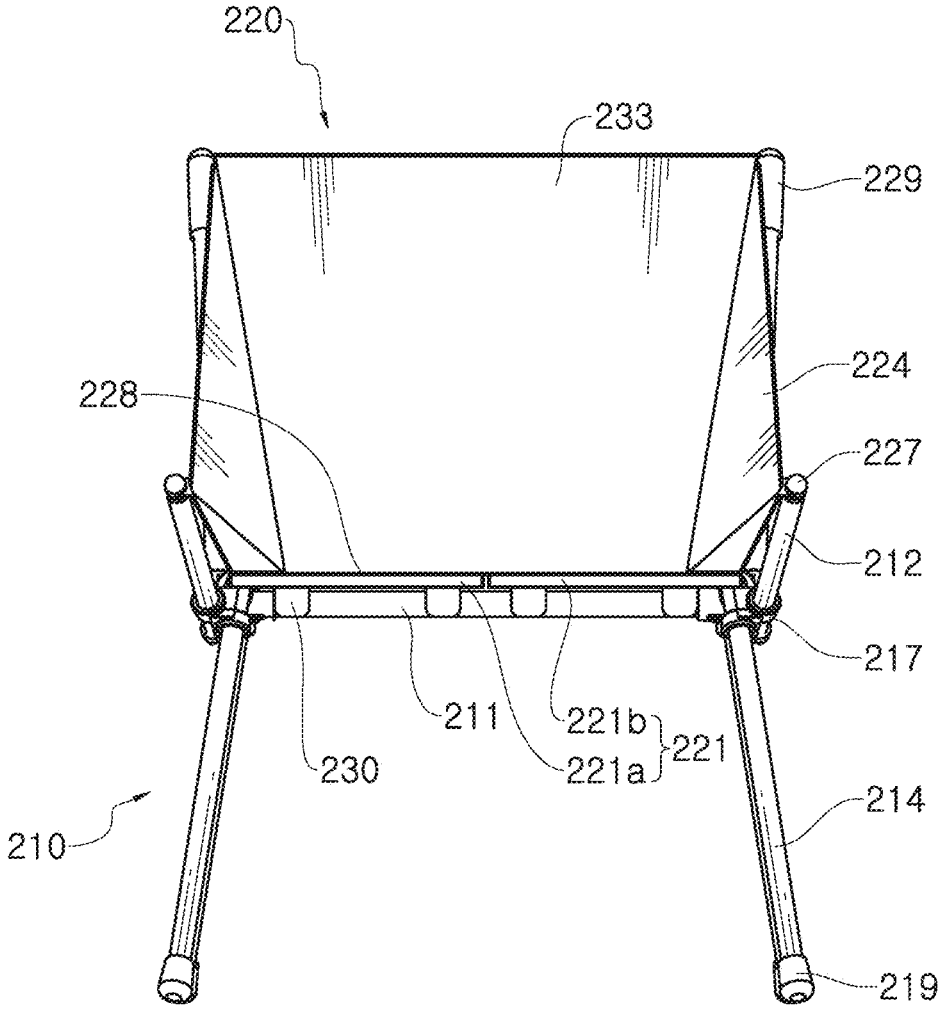
FIG. 7 is a front view showing the portable chair according to the second embodiment of the present disclosure.
Figure 8:
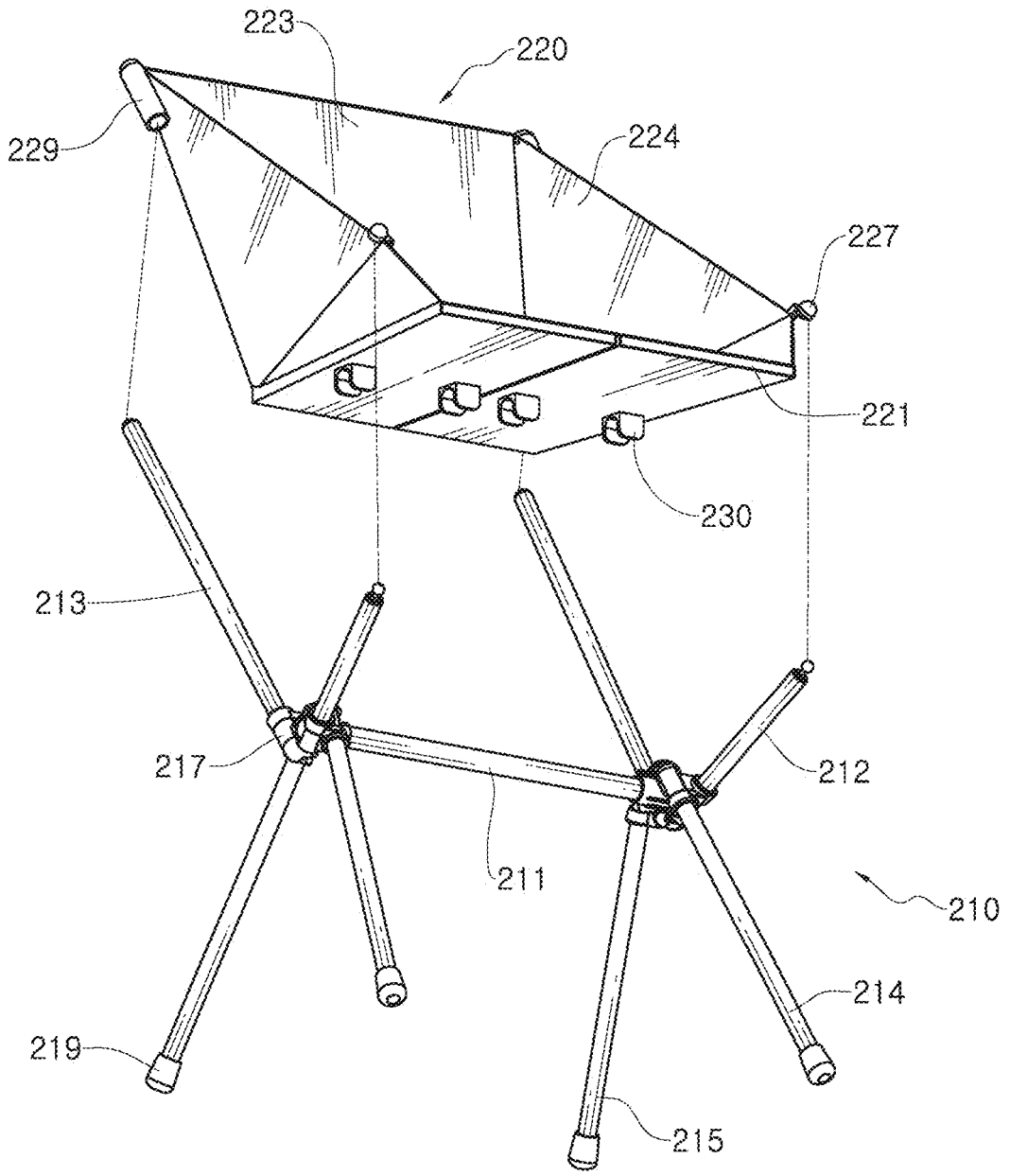
FIG. 8 is an exploded perspective view showing the portable chair according to the second embodiment of the present disclosure.

FIG. 5 is a perspective view showing a portable chair according to the second embodiment of the present disclosure. FIG. 6 is a side view showing the portable chair according to the second embodiment of the present disclosure. FIG. 7 is a front view showing the portable chair according to the second embodiment of the present disclosure. FIG. 8 is an exploded perspective view showing the portable chair according to the second embodiment of the present disclosure. Hereinafter, the portable chair according to the second embodiment of the present disclosure will be described with reference to FIGS. 5 to 8. Features identical or corresponding to the portable chair according to the first embodiment of the present disclosure are designated by the same or corresponding reference numerals and will not be described in detail.

Referring to FIGS. 5 to 8, the portable chair according to the second embodiment of the present disclosure includes a chair frame 210, a chair cover 220, and a seat member 221. The chair cover 220 has a rear surface 223 and a pair of side surfaces 224. In addition, the portable chair according to the second embodiment of the present disclosure may include or may not include the rear support member 122 of the portable chair according to the first embodiment. The portable chair according to the second embodiment of the present disclosure differs from the portable chair according to the first embodiment in terms of the structures of the chair frame 210 and the chair cover 220 and the coupling method of the chair frame 210 and the chair cover 220.

More specifically, the chair frame 210 includes a central support pole 211, a plurality of front support poles 212, a plurality of rear support poles 213 and a plurality of leg poles 214, 215. However, the rear support pole 213 according to the second embodiment does not have a curved shape unlike the rear support pole 113 according to the first embodiment. The central support poles 211, the front and rear support poles 212, 213 and the plurality of leg poles 214, 215 are detachably coupled to each other through a pairs of hubs 217 coupled to both ends of the central support pole 211. In addition, protection caps 219 are respectively coupled to free ends of the plurality of leg poles 214, 215.

The seat member 221 is made of a hard material (for example, a plastic board), so that when the user sits on the chair, the seat member 221 stably supports the user to give comfort seating feeling without sagging downward. The seat member 221 may be inserted into the chair cover 220 or may be coupled to an outer side thereof. In addition, the bottom surface of the seat member 221 according to the second embodiment of the present disclosure is supported in contact with the central support pole 211. Thus, the central support pole 211 may help to support the weight of the user, thereby supporting the weight of the user more stably.

In addition, the seat member 221 includes two boards 221*a*, 221*b*, which are configured to be folded and hinged to each other. More specifically, the seat member 221 is made of two boards 221*a*, 221*b*, which are coupled in a direction perpendicular to the longitudinal direction of the central support pole 211. The two boards 221*a*, 221*b* are coupled so that their surfaces toward the upper side of the seat member 221 are folded inward to face each other (see FIG. 9). Thus, when the chair frame 210 and the chair cover 220 are separately stored, the volume occupied by the chair cover 220 may be reduced by folding the seat member 221. In addition, in use, the user seats on the seat member 221 to apply a force in the direction in which the seat member 221 is unfolded, thereby preventing the seat member 221 from being folded during use.

Even though the embodiment depicted in the figures illustrate that the seat member 221 is made of two boards, the seat member 221 may also be made of three or more boards hinged to each other.

In addition, the hinge coupling of the boards of the seat member 221 may be performed by a hinge member such as a hinge or may be performed by connecting the boards with a flexible material.

Also, the seat member 221 may be made of a plurality of rods extending in a direction crossing the central support pole 211 and spaced apart from each other at predetermined intervals in the direction along which the central support pole 211 extends, instead of the boards. In this case, the plurality of rods may be provided to a portion where the user sits inside the chair cover 220, thereby preventing the chair cover 220 from sagging downward even when the user sits on the chair.

Meanwhile, the chair cover 220 of the portable chair according to the second embodiment includes an elastic clip 230 protruding at the bottom surface of the seat member 221 (see FIG. 7 or 8). As the central support pole 211 is inserted into the elastic clip 230, the chair cover 220 is fixed to the central support pole 211. As described above, since the seat member 221 is supported by the central support pole 211, the user sitting on the seat member 221 may be supported more stably. Further, since the chair cover 220 includes the elastic clip 230, the location of the seat member 221 in the horizontal direction is fixed, thereby preventing the seat member 221 from being displaced in the front and rear direction.

The elastic clip 230 is provided in plural, and the plurality of elastic clips 230 are spaced apart from each other along the longitudinal direction of the central support pole 211 so as not to disturb folding of the seat member 221. The shape of the elastic clip 230 is not particularly limited but may have an opening through which the central support pole 211 is inserted and a pair of protrusions protruding downward to form the opening.

Figure 10:
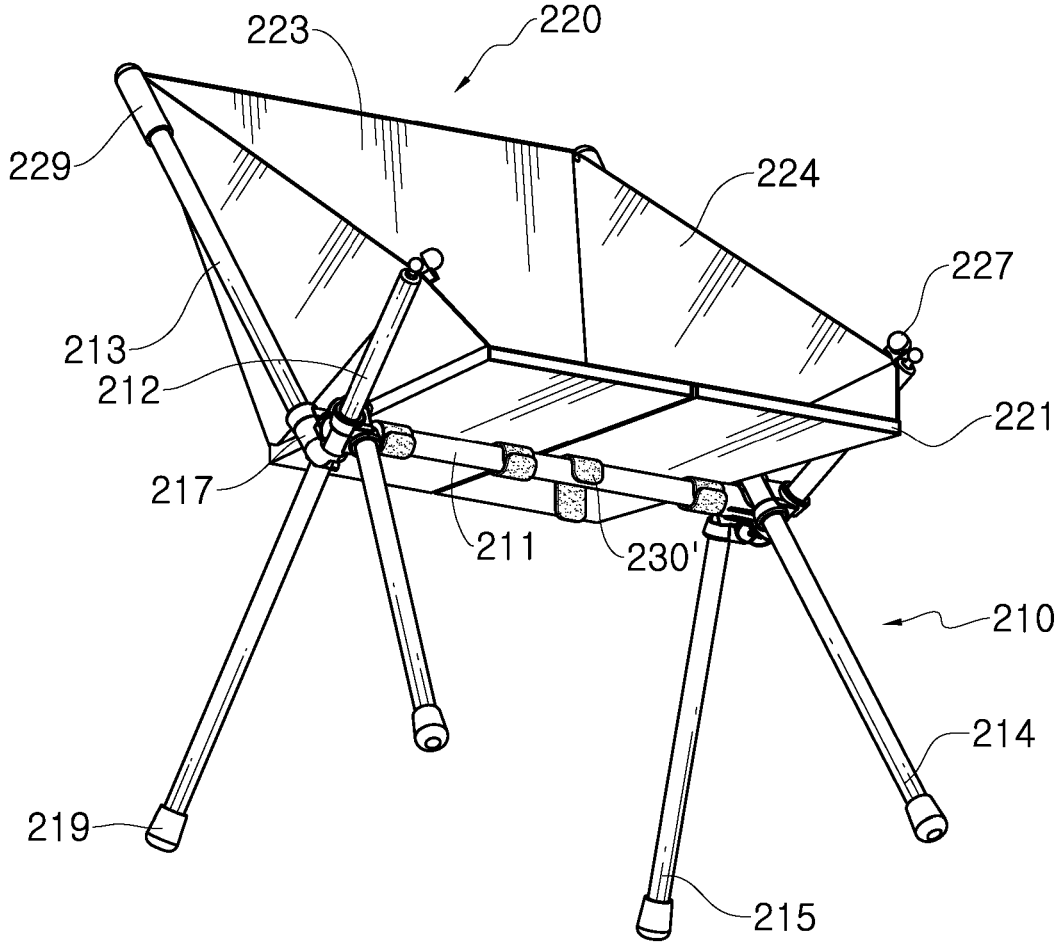
FIG. 10 is a perspective view showing a portable chair showing additional features of the present disclosure.

Alternatively, the chair cover 220 may include a Velcro tape 230' (shown in FIG. 10) coupled to the bottom surface of the seat member 221 to fix the central support pole 211. As the central support pole 211 is attached to the seat member 221 or the chair cover 220 by means of the Velcro tape 230', the central support pole 211 may give substantially the same effect as when the elastic clip 230 is provided. The Velcro tape 230' may also be provided in plural along the longitudinal direction of the central support pole 211.

In addition, the chair cover 220 includes pockets 227, 229 for coupling with the chair frame 210. The pockets 227, 229 includes a front pocket 227 and a rear pocket 229 formed at locations corresponding to the free ends of the front support pole 212 and the rear support pole 213 in the portion (the rear surface 223 or the side surface 224) made of a flexible material.

The front pocket 227 is coupled to the free end of the front support pole 212 in a snap-fitting fashion. For convenient coupling, the front pocket 227 is formed to protrude toward the free end of the front support pole 212 from a location corresponding to the free end of the front support pole 212 at the pair of side surfaces 224 (see FIG. 7). In addition, the rear pocket 229 is formed to extend along the longitudinal direction of the rear support pole 213 so that the free end of the rear support pole 213 is inserted into the rear pocket 229 deeper than the front support pole 212 inserted into the front pocket 227.

Also, referring to FIG. 6, the front end A of seat member 221 protrudes forward further to the free end B of the front support pole 212 in the horizontal direction, and the free end D of the rear support pole 213 is rearward further to the rear end C of the seat member 221 in the horizontal direction. Thus, in use, the forward rotation of the seat member 221 about the central support pole 211 is prevented by the elastic force of the chair cover 220 formed between the front support pole 212 and the front pocket 227, and the rearward rotation of the seat member 221 about the central support pole 211 is prevented by the elastic force of the chair cover 220 formed between the rear support pole 213 and the rear pocket 229. In particular, since the front end of the seat member 221 protrudes forward further to the free end of the front support pole 212 in the horizontal direction, it is possible to stably prevent the seat member 221 from rotating forward even if the user moves the center of gravity forward.

In addition, the portable chair according to the second embodiment of the present disclosure includes a cushion member 228 coupled to an upper surface of the seat member 221. The cushion member 228 may give the user with more comfortable seating feeling. The cushion member 228 may be formed at an inner side of the upper surface of the seat member 221 or may be coupled to an outer side of the upper surface of the seat member 221.

Figure 9A:
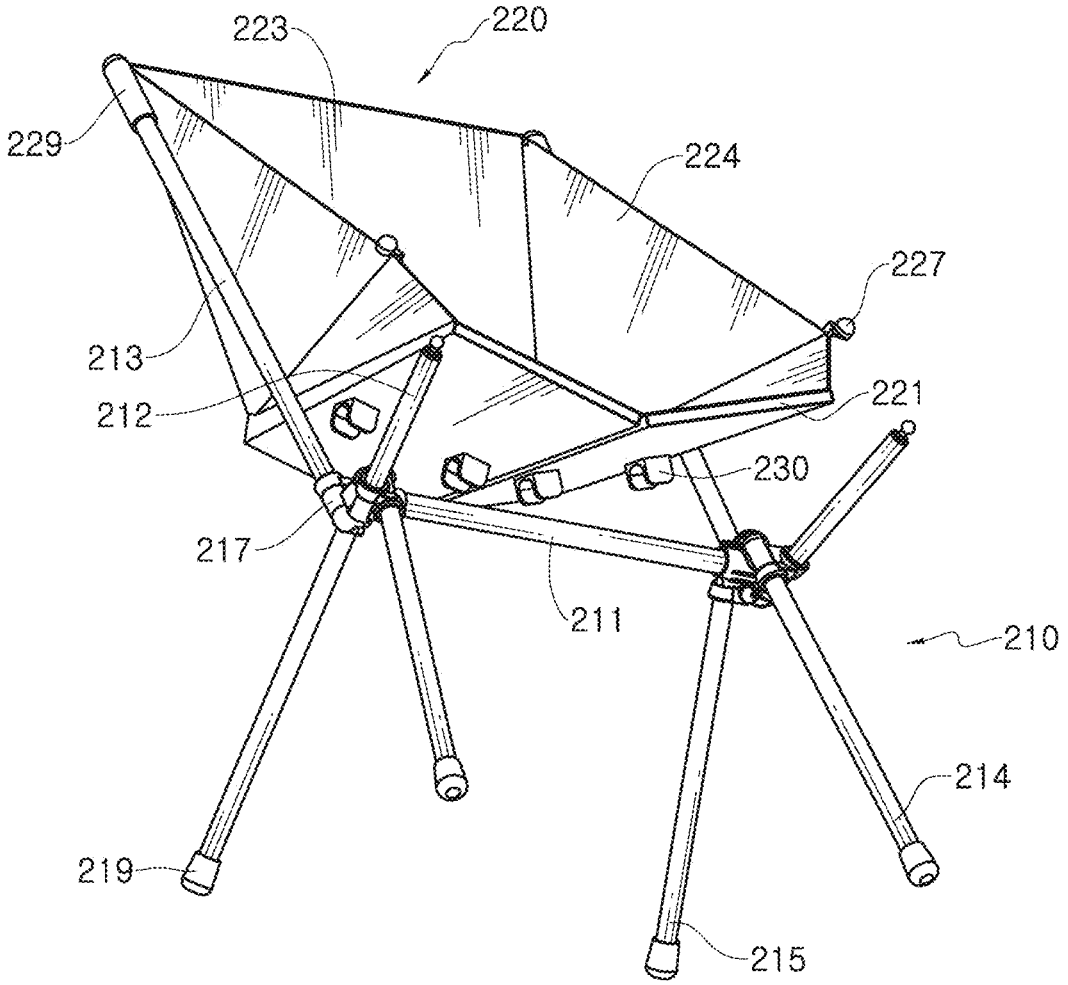
FIGS. 9A to 9C are diagrams for illustrating a process of coupling a chair cover according to the second embodiment of the present disclosure to a chair frame in order.
Figure 9B:
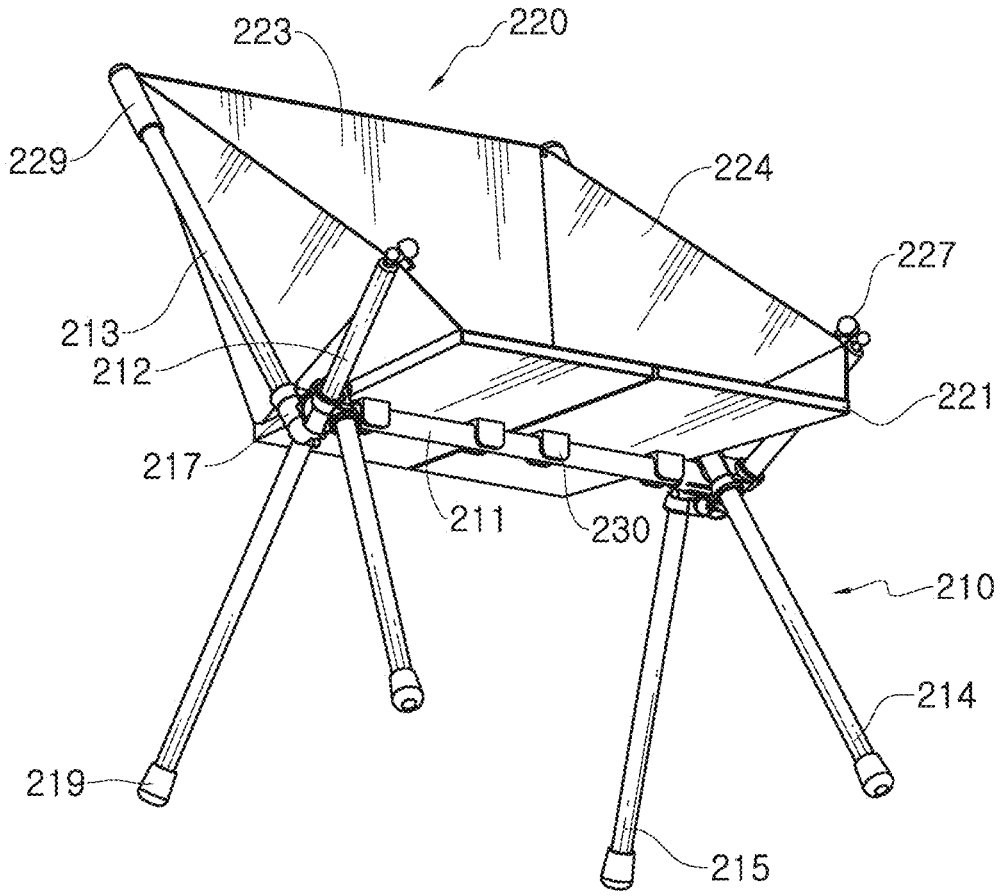
Figure 9C:
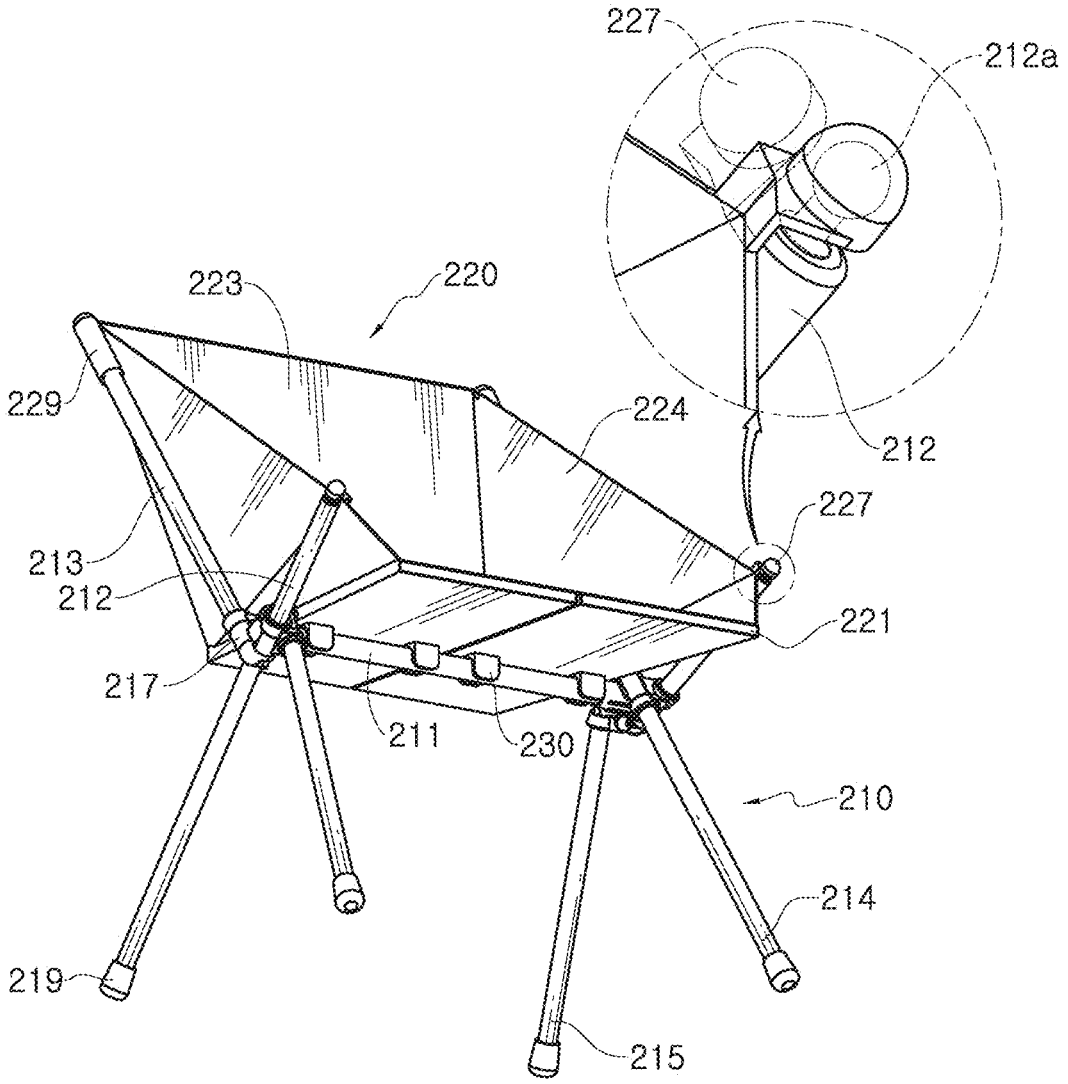

FIGS. 9A to 9C are diagrams for illustrating a process of coupling the chair cover 220 to the chair frame 210 in order. Hereinafter a method of assembling the portable chair by coupling the chair frame 210 and the chair cover 220 will be described with reference to FIGS. 9A to 9C. However, the coupling order of the chair frame 210 and the chair cover 220 is not limited thereto and may be appropriately changed.

First, referring to FIG. 9A, the chair frame 210 formed by coupling a plurality of poles is prepared. In addition, the free ends of the rear support poles 213 of the chair frame 210 are respectively inserted into the rear pockets 229 of the chair cover 220. At this time, the seat member 221 may be in an inwardly folded state. Since the rear pocket 229 is formed to extend along the longitudinal direction of the rear support pole 213, the chair cover 220 may be firmly fixed to the chair frame 210 only by inserting the rear support pole 213 into the rear pocket 229.

Next, referring to FIG. 9B, the folded seat member 221 is unfolded to be coupled to the central support pole 211. In addition, the central support pole 211 is coupled to the plurality of elastic clip 230 at the bottom surface of the seat member 221.

Finally, as shown in FIG. 9C, the free ends of the front support poles 212 are coupled to the front pockets 227 in a snap-fitting fashion. More specifically, a spherical coupling protrusion 212*a* is formed at an end of the front support pole 212, and a groove for snap-fitting with the coupling protrusion 212*a* is formed at the front pocket 227. The front pocket 227 separated from the front support pole 212 as indicated by a dotted line in the enlarged view of FIG. 9C is rotated toward the front support pole 212 as indicated by a solid line in the enlarged view of FIG. 9C, so that the front pocket 227 is snap-fitted with the coupling protrusion 212*a* of the front support pole 212, thereby fully fixing the chair cover 220 to the chair frame 210.

Since the front pocket 227 is formed to protrude from the side surface 224 toward the free end of the front support pole 212 as described above, in a state where the rear support pole 213 and the seat member 221 are coupled to the chair frame 210, the front support pole 212 and the front pocket 227 may be easily coupled without applying a force for elastically deforming the plurality of poles.

Meanwhile, when detaching the chair cover 220 from the chair frame 210, the snap-fitting between the front pocket 227 and the front support pole 212 is released, the elastic clips are separated from the central support pole 211, and then the rear pocket 229 is separated from the rear support pole 213, contrary to the coupling operation. In this way, the chair cover 220 may be conveniently separated from the chair frame 210.

The above description is merely illustrative of the technical idea of the present disclosure, and various changes and modifications can be made by those skilled in the art without departing from the essential characteristics of the present disclosure. Accordingly, the embodiments in the present disclosure are intended to be illustrative rather than limiting, and are not intended to limit the scope of the present disclosure. The scope of the present disclosure is to be construed in accordance with the appended claims and all technical ideas within the equivalent scope shall be construed as being included in the scope of the present disclosure.

REFERENCE NUMERALS

110, 210: chair frame
111, 211: central support pole
112, 212: front support pole
113, 213: rear support pole
114, 214: front leg pole
115, 215: rear leg pole
119, 219: protection cap
117, 217: hub
120, 220: chair cover
121, 221: seat member
123, 223: rear surface
124, 224: side surface
127, 227: front pocket
228: cushion member
129, 229: rear pocket
230: elastic clip

The invention claimed is:

1. A portable chair, comprising:

a chair frame formed by detachably coupling a plurality of poles;

a chair cover detachably coupled to the chair frame and made of a material adapted to support the body of a user, wherein the material is a type that does not restrain movement of the user; and a seat member installed at a portion of the chair cover, adapted to support a hip portion of the user, and made of a harder material than the material adapted to support the body of the user, wherein the chair frame includes:

a central support pole disposed in parallel to the ground;

a plurality of front support poles respectively having base ends detachably connected to both ends of the central support pole and respectively having free ends extending in a front upper direction at a predetermined angle with the ground;

a plurality of rear support poles respectively having base ends detachably connected to both ends of the central support pole and respectively having free ends extending in a rear upper direction at a predetermined angle with the ground; and a plurality of leg poles respectively having base ends detachably connected to both ends of the central support pole and respectively having free ends extending in a lower direction to contact the ground, and wherein the seat member has a bottom surface supported by an attachment in contact with the central support pole.

2. The portable chair according to claim 1, wherein the seat member is made of two or more boards, which are coupled to be folded with each other.

3. The portable chair according to claim 1, wherein the chair cover has the attachment including an elastic clip protruding on the bottom surface of the seat member and is fixed to the central support pole as the central support pole is inserted into the elastic clip.

4. The portable chair according to claim 1, wherein the chair cover includes a hook and loop type tape coupled to the bottom surface of the seat member to fix the central support pole.

5. The portable chair according to claim 1, wherein the chair cover has pockets provided at locations corresponding to the free ends of the front support poles and the rear support poles to be coupled with the free ends, respectively.

6. The portable chair according to claim 5, wherein the free ends of the front support poles and the pockets corresponding thereto are coupled with each other in a snap-fitting fashion.

7. The portable chair according to claim 1, further comprising:

a cushion member coupled to an upper surface of the seat member.

* * * * *